US007517272B2

(12) United States Patent
Bedford et al.

(10) Patent No.: US 7,517,272 B2
(45) Date of Patent: Apr. 14, 2009

(54) PLAY SET WITH TOY VEHICLE TRACK AND CARRIAGE

(76) Inventors: Jonathan Bedford, 5531 Wiseburn, Hawthorne, CA (US) 90250; Eric So, 23B, Block 3, Tivoli Garden, Tsing Yi (HK)

( * ) Notice: Subject to any disclaimer, the term of this patent is extended or adjusted under 35 U.S.C. 154(b) by 277 days.

(21) Appl. No.: 11/334,180

(22) Filed: Jan. 17, 2006

(65) Prior Publication Data

US 2007/0259600 A1 Nov. 8, 2007

Related U.S. Application Data

(60) Provisional application No. 60/691,465, filed on Jun. 16, 2005.

(51) Int. Cl.
*A63H 18/00* (2006.01)

(52) U.S. Cl. ..... 446/444

(58) Field of Classification Search ..... 446/444–447, 446/396; 238/10 E, 10 F; 104/295, 53, 60
See application file for complete search history.

(56) References Cited

U.S. PATENT DOCUMENTS

| | | | | |
|---|---|---|---|---|
| 1,506,771 | A | 9/1924 | O'Leary | |
| 2,239,395 | A | 4/1941 | Mallory | |
| 2,392,722 | A * | 1/1946 | Burlin | 104/55 |
| 3,126,670 | A | 3/1964 | Smith | |
| 3,299,565 | A | 1/1967 | Yarashes | |
| 3,308,575 | A | 3/1967 | Lemelson | |
| 3,451,161 | A | 6/1969 | Lemelson | |
| 3,494,070 | A | 2/1970 | Lemelson | |
| 3,518,789 | A * | 7/1970 | Domashovetz | 446/445 |
| 3,531,119 | A * | 9/1970 | Bonanno | 463/68 |
| 3,559,334 | A * | 2/1971 | Beny et al. | 446/445 |
| 3,633,308 | A | 1/1972 | Yang | |
| 3,656,586 | A | 4/1972 | Robson | |
| 3,665,636 | A | 5/1972 | Benson et al. | |
| 3,690,393 | A | 9/1972 | Guy | |
| 3,707,805 | A | 1/1973 | Buck | |
| 3,797,164 | A | 3/1974 | Glass | |
| 3,953,938 | A | 5/1976 | Kilgore | |
| 4,045,908 | A * | 9/1977 | Ensmann et al. | 446/441 |
| 4,068,392 | A | 1/1978 | Montgomery | |
| 4,068,402 | A | 1/1978 | Tanaka | |
| 4,087,935 | A | 5/1978 | Edmisson et al. | |
| 4,091,995 | A | 5/1978 | Barlow et al. | |

(Continued)

FOREIGN PATENT DOCUMENTS

| | | |
|---|---|---|
| CA | 2396567 | 7/2001 |

(Continued)

OTHER PUBLICATIONS

Canadian Office Action mailed Dec. 7, 2007 for Canadian application No. 2,525,039.

(Continued)

*Primary Examiner*—Gene Kim
*Assistant Examiner*—Alyssa M Hylinski

(57) ABSTRACT

In some examples, a toy vehicle play set may include an elongate track having a first vehicle-support surface defining a travel path, and a carriage mounted for travel along the travel path and having a second vehicle-support surface. The first and second vehicle-support surfaces may be configured to support, in combination, a toy vehicle.

21 Claims, 10 Drawing Sheets

U.S. PATENT DOCUMENTS

| | | | | |
|---|---|---|---|---|
| 4,106,695 | A | 8/1978 | Carella et al. | |
| 4,185,409 | A | 1/1980 | Cheng | |
| 4,221,076 | A | 9/1980 | Ozawa | |
| 4,241,534 | A | 12/1980 | Larsson et al. | |
| 4,254,576 | A | 3/1981 | Matsumoto et al. | |
| 4,312,151 | A | 1/1982 | Orenstein | |
| 4,333,261 | A | 6/1982 | Jones et al. | |
| 4,386,777 | A | 6/1983 | Prehodka | |
| 4,388,036 | A * | 6/1983 | Okamoto | 414/537 |
| 4,459,438 | A | 7/1984 | Kaiser | |
| 4,468,031 | A | 8/1984 | Barlow et al. | |
| 4,519,789 | A | 5/1985 | Halford | |
| 4,536,168 | A | 8/1985 | Stephens | |
| 4,536,169 | A | 8/1985 | Fekete et al. | |
| 4,650,438 | A * | 3/1987 | Ajiro | 446/136 |
| 4,661,080 | A | 4/1987 | Goldstein et al. | |
| 4,697,812 | A | 10/1987 | Rudell et al. | |
| 4,940,444 | A | 7/1990 | Russell | |
| 4,979,926 | A | 12/1990 | Bisceglia | |
| 4,990,117 | A | 2/1991 | Yonezawa | |
| 5,038,685 | A | 8/1991 | Yoneda | |
| 5,052,972 | A | 10/1991 | Suimon et al. | |
| 5,080,627 | A | 1/1992 | Oriya et al. | |
| 5,165,347 | A | 11/1992 | Wagner | |
| 5,342,048 | A | 8/1994 | Jones et al. | |
| 5,452,893 | A | 9/1995 | Faulk et al. | |
| 5,601,490 | A | 2/1997 | Nakagawa et al. | |
| 5,678,489 | A | 10/1997 | Wang | |
| 5,865,661 | A * | 2/1999 | Cyrus et al. | 446/136 |
| 5,890,945 | A | 4/1999 | Asami et al. | |
| 5,931,714 | A | 8/1999 | Johnson | |
| 5,974,977 | A | 11/1999 | Johnson et al. | |
| 6,093,079 | A | 7/2000 | House | |
| 6,173,654 | B1 * | 1/2001 | Ngai | 104/295 |
| 6,193,581 | B1 | 2/2001 | Wiggs et al. | |
| 6,422,151 | B2 | 7/2002 | Maleika | |
| 6,478,654 | B1 | 11/2002 | Rehkemper et al. | |
| 6,482,070 | B2 | 11/2002 | Hogan | |
| 6,508,179 | B2 | 1/2003 | Annis et al. | |
| 6,602,107 | B1 | 8/2003 | Hogan | |
| 6,648,723 | B2 * | 11/2003 | Clark et al. | 446/444 |
| 6,676,480 | B2 | 1/2004 | Sheltman | |
| 6,764,376 | B2 | 7/2004 | Agostini | |
| 6,805,609 | B1 | 10/2004 | Paukert | |
| 2003/0224697 | A1 | 12/2003 | Sheltman et al. | |

FOREIGN PATENT DOCUMENTS

| | | | |
|---|---|---|---|
| DE | 3240712 | | 5/1984 |
| DE | 3409975 | | 9/1985 |
| DE | 3500533 | | 7/1986 |
| DE | 3625667 | | 1/1987 |
| DE | 3628961 | | 11/1987 |
| DE | 3941093 | | 6/1991 |
| EP | 0091971 | | 10/1983 |
| EP | 0200837 | | 11/1986 |
| EP | 0105058 | | 12/1987 |
| EP | 0280496 | | 8/1988 |
| EP | 1120144 | | 8/2001 |
| GB | 0477953 | | 1/1938 |
| GB | 1380660 | | 1/1975 |
| GB | 2123704 | | 2/1984 |
| GB | 2180768 | | 4/1987 |
| GB | 2230467 | | 10/1990 |
| JP | 6081504 | A | 3/1994 |
| WO | 0123058 | | 4/2001 |
| WO | 2004016333 | | 2/2004 |

OTHER PUBLICATIONS

Rev-Ups Skyway Stunt Set, 12 sheets total, comprising: (A) Fall 2004 Mattel Toy Sell Sheets, cover page and p. 39 showing Rev-Ups Skyway Stunt Set (2 sheets); (B) Photographs showing product packaging (2 sheets); and photographs showing the product (8 sheets). The Rev-Ups Skyway Stunt Set was publicly disclosed in the Toy Sell Sheets in the fall of 2004.

Moon Adventure toy play set, sold by Guangdong Auldey Toy Industry Ltd of Guangdong, China, package shows a 2004 copyright notice, 6 sheets total, comprising: (A) photographs of the package for the toy playset (2 sheets) and (B) photographs of the toy playset (4 sheets).

U.S. Patent and Trademark Office, Office action for U.S. Appl. No. 11/333,988, mailing date Jul. 1, 2008, 30 pages. The '998 application has the same inventors as the present '180 application. The '998 OA includes English abstract of JP6081504A cited above.

U.S. Patent and Trademark Office, Office action for U.S. Appl. No. 11/333,987, mailing date Sep. 11, 2008, 11 pages. The '997 application has the same inventors as the present '180 application.

Division of Patents of the Mexican Institute of Industrial Property, Office Action for Mexican patent application No. PA/a/2005/011764 (which has the same inventors as U.S. Appl. No. 11/334,180), dated Aug. 26, 2008, seven pages total. This disclosure includes the Spanish-language Office action plus a partial English-language translation prepared by our Mexican agent.

Canadian Intellectual Property Office, Patent Examiner Javier Jorge, Office Action for Canadian patent application No. 2,525,022 (which corresponds U.S. Appl. No. 11/334,180), dated Nov. 27, 2008, three pages total. Applicants concurrently disclose CA 2,396,567 (national phase of WO 2001/51155) cited in this Office action.

* cited by examiner

PLAY SET WITH TOY VEHICLE TRACK AND CARRIAGE

RELATED APPLICATION

This application claims the benefit of U.S. Provisional Application No. 60/691,465, filed on Jun. 16, 2005, Mexican Application No. 2005/011690, filed Nov. 1, 2005 of the same title, and Canadian Application No. 2005/2525022, filed Nov. 1, 2005 of the same title, which are incorporated herein by reference for all purposes.

BACKGROUND OF THE DISCLOSURE

Toy vehicle tracks and accompanying toy vehicles are a source of entertainment for children. Toy vehicle tracks having different features may increase the enjoyment of children using the tracks.

The toy vehicles used on a toy vehicle track may utilize any suitable type of propulsion. For example, toy vehicles may allow the wheels on the toy vehicle to spin freely when pushed. Toy vehicles may also be propelled by an energy source, such as by using one or more batteries or other source of electric power, by using magnetic forces, by using mechanical forces such as provided by a spring, or by using an inertial flywheel motor that gains its rotational energy by spinning the wheels of the toy vehicle. Toy vehicles may maintain contact with a track in various ways. For example, contact between the vehicle and the track may be maintained by gravity, by utilizing the speed of the propelled toy vehicle, by using magnetic forces, and/or by securing the toy vehicle to the track mechanically.

Examples of toy vehicle tracks can be found in U.S. Pat. Nos. 2,239,395, 3,126,670, 3,299,565, 3,665,636, 3,690,393, 3,797,164, 4,068,402, 4,087,935, 4,091,995, 4,106,695, 4,185,409, 4,221,076, 4,254,576, 4,459,438, 4,468,031, 4,519,789, 4,536,168, 4,661,080, 4,697,812, 4,979,926, 5,052,972, 5,452,893, 5,601,490, 5,678,489, 5,865,661, 5,890,945, 5,931,714, 6,093,079, 6,193,581, 6,478,654, 6,508,179, 6,676,480, RE32,106 and U.S. Application Publication No. 2003/0224697. Different types of toy vehicles suitable for use on toy vehicle tracks can be found in U.S. Pat. Nos. 4,087,935, 4,241,534, 4,333,261, 4,536,169, 4,940,444, 6,422,151, and 6,764,376. All of the aforementioned patents are incorporated herein by reference for all purposes.

SUMMARY OF THE DISCLOSURE

In some examples, a toy vehicle play set may include a track assembly having a first vehicle-support surface defining a travel path, and a carriage mounted for travel along the travel path and having a second vehicle-support surface. The first and second vehicle-support surfaces may be configured to support, in combination, a toy vehicle.

In some examples, a toy vehicle play set may include a track having an end. The track may be configured to support a toy vehicle having at least a wheel on each side of a vehicle body. A rail may be supported relative to and extending from the end of the track. A carriage may be mounted for travel along the rail and have a vehicle-support surface. The carriage may be adapted to support at least partially a toy vehicle and be movable along the rail between a position near the end of the track and a position spaced from the end of the track.

In some examples, a method of propelling a toy vehicle along a track may include supporting the toy vehicle on a carriage with at least a first driven wheel of the vehicle supported on the track, driving the driven wheel of the supported toy vehicle, and guiding the carriage supporting the toy vehicle along the track.

DETAILED DESCRIPTION

A toy vehicle play set may include a track adapted for use with a toy vehicle. For example, a toy vehicle play set may include an elongate track assembly having a first vehicle-support surface defining a travel path, and a carriage mounted for travel along the travel path and having a second vehicle-support surface. The first and second vehicle-support surfaces may be configured to support, in combination, a toy vehicle.

In other examples, a toy vehicle play set may include a track having an end and configured to support a toy vehicle having at least a wheel on each side of a vehicle body. A rail may be supported relative to and extending from the end of the track. A carriage may be mounted for travel along the rail and may have a vehicle-support surface. The carriage may be movable along the rail between a position near the end of the track and a position spaced from the end of the track.

Also, in some examples, a method of propelling a toy vehicle along a track may include supporting the toy vehicle on a carriage with at least a first driven wheel of the vehicle supported on a track, driving the driven wheel of the supported toy vehicle, and guiding the carriage supporting the toy vehicle along the track.

Also, in some examples, the toy vehicle may be unmotorized or may be motorized, and may have a single speed or a plurality of speeds. The track may be formed with plastic, although other suitable materials, such as metal, may also be used. Furthermore, sections of the track may be molded, although they may also be formed in various other ways as well, such as by cutting or pressing. The track may be comprised of multiple sections that may need to be assembled by the user before using the track. The track may be assembled by various connectors, including any sort of snap fit structure, registration pins, retaining clips, flanges, or any other integral or non-integral structure capable of attaching two or more sections of the track together.

Figure 1:
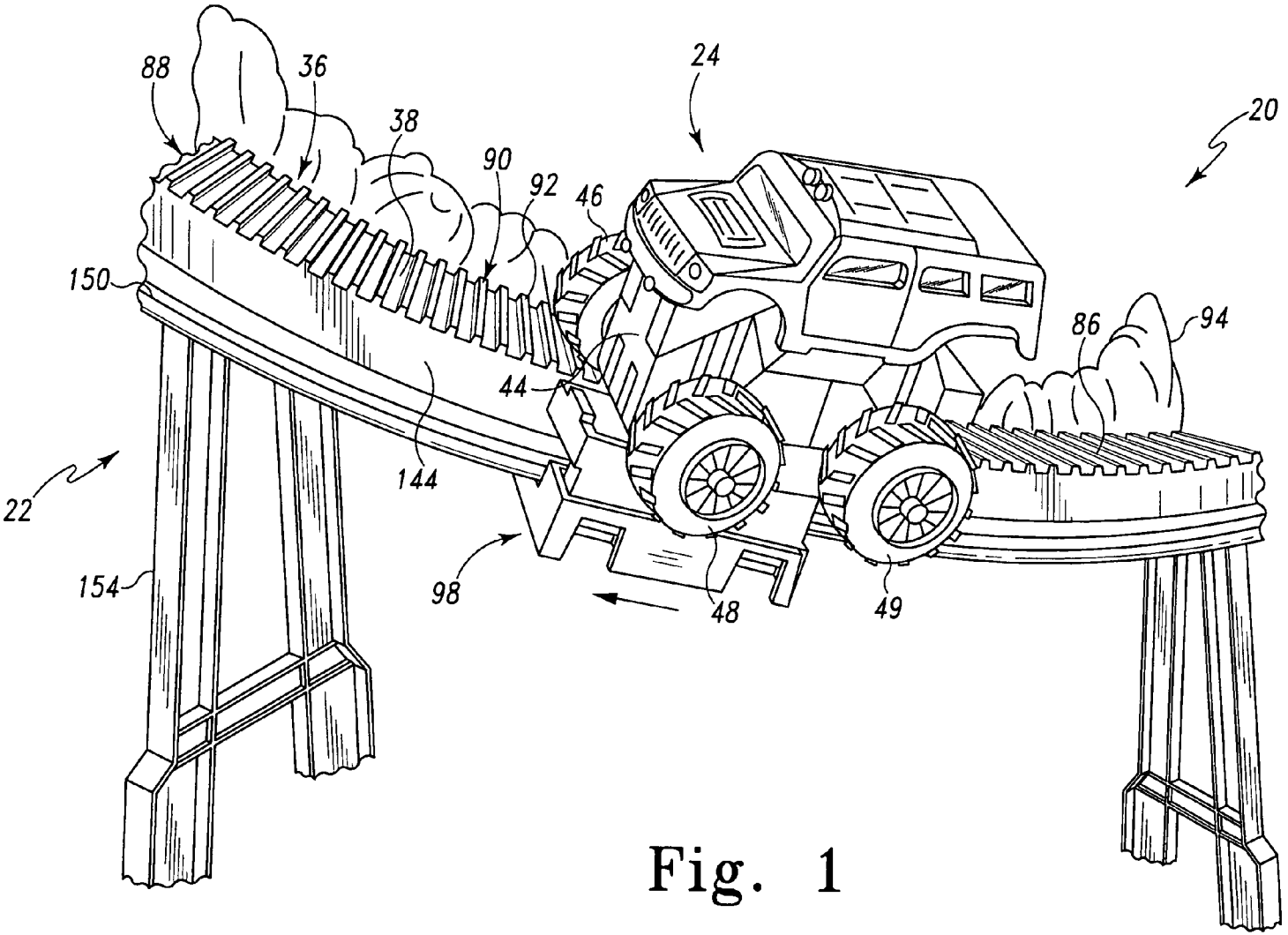
FIG. 1 is a perspective view of a play set including a toy vehicle supported on a track assembly.
Figure 2:
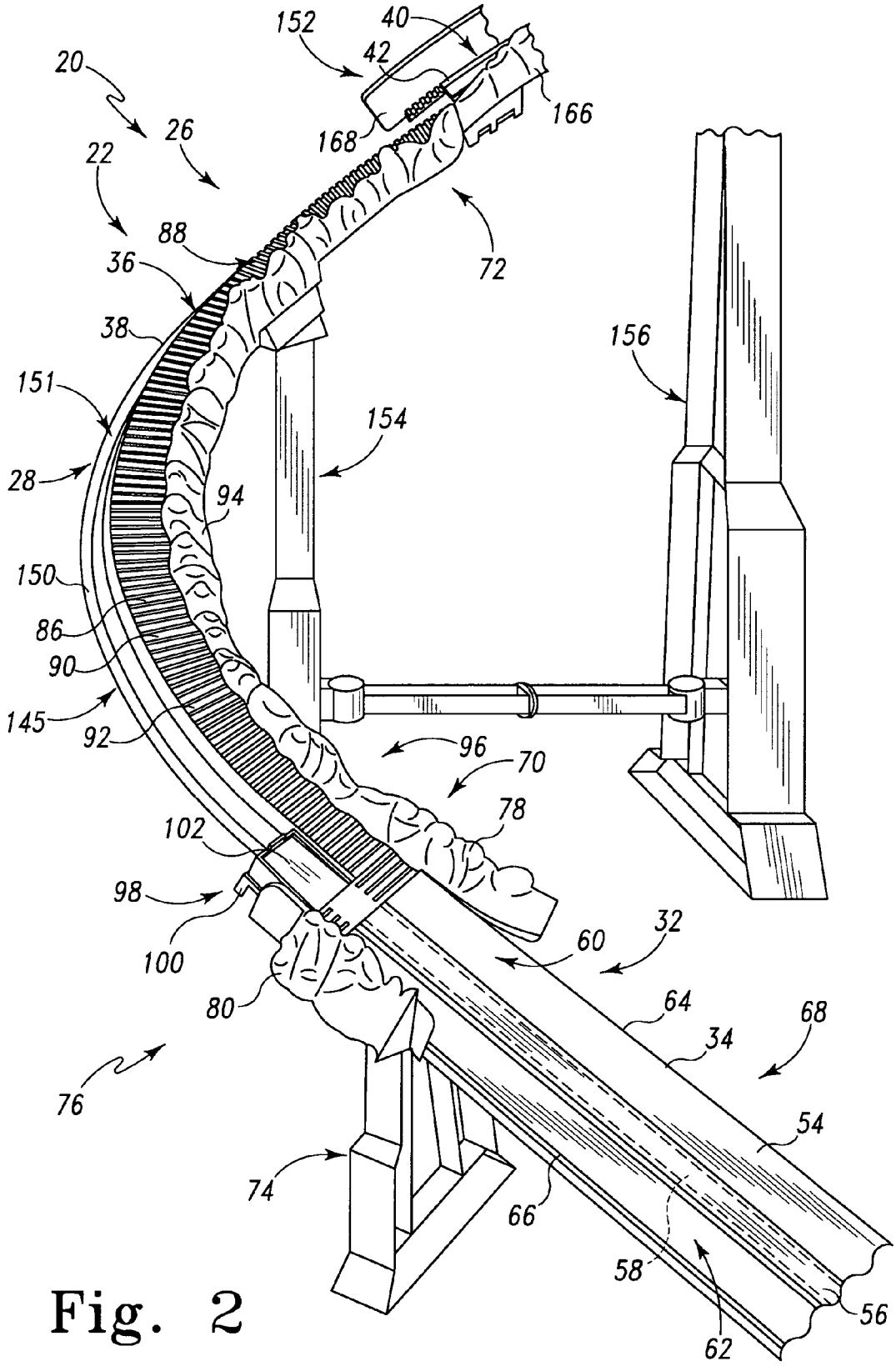
FIG. 2 is a perspective view of an inclined toy-vehicle play set including the track assembly of FIG. 1.

FIGS. 1 and 2 depict a perspective view of one example of a toy vehicle play set shown generally at 20. Play set 20 may include a track set 22 and one or more toy vehicles, such as toy vehicle 24. Track set 22 may include track assemblies 26 having one or more tracks 28 serially positioned to define one or more travel paths, such as a continuous travel path 30 for a toy vehicle 24. In this example, there is a first track assembly 32 having a track 34, a second track assembly 36 having a track 38, and a third track assembly 40 having a track 42.

Figure 5:
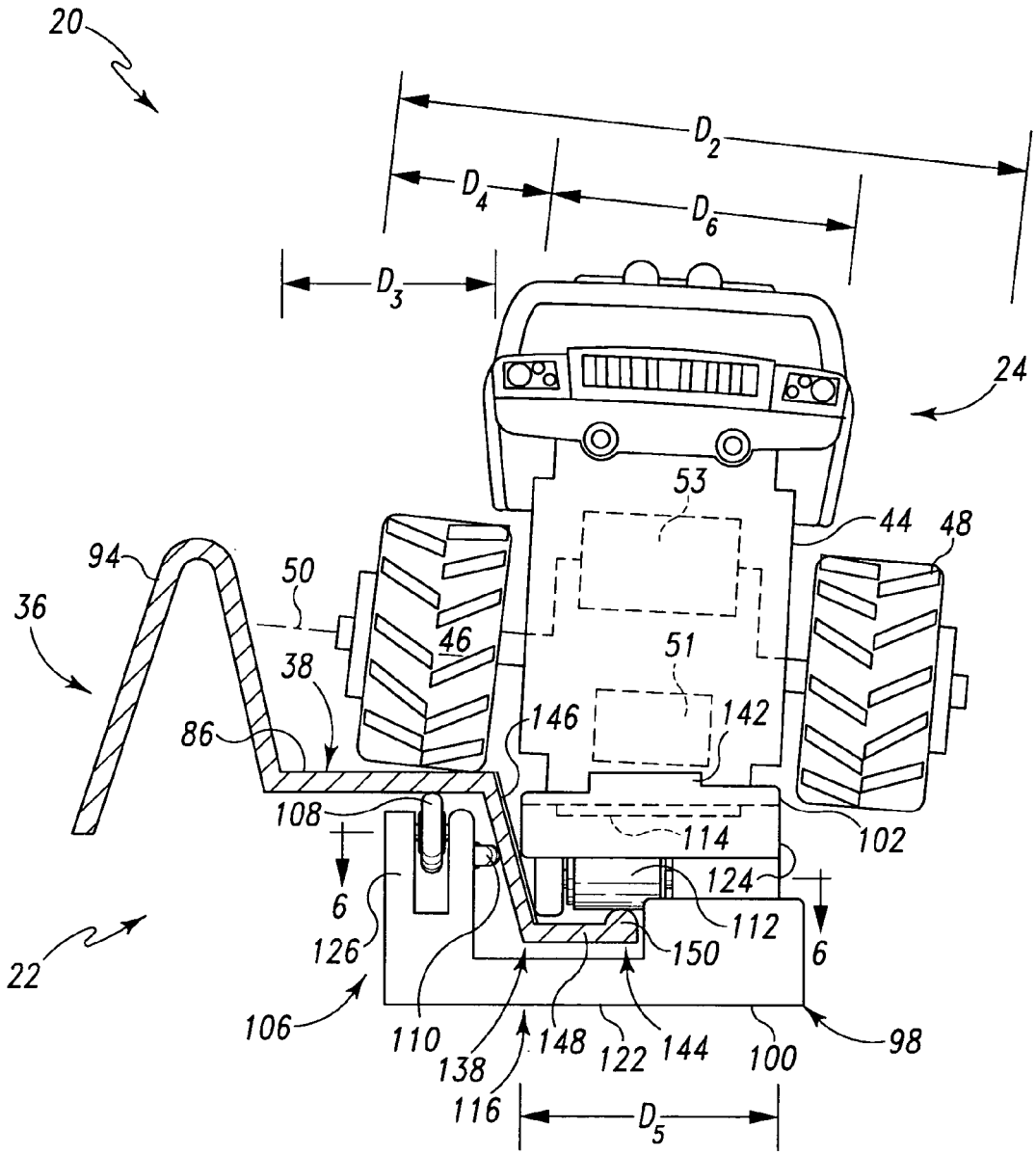
FIG. 5 is a front view of the vehicle supported on the track assembly of FIG. 1.
Figure 6:
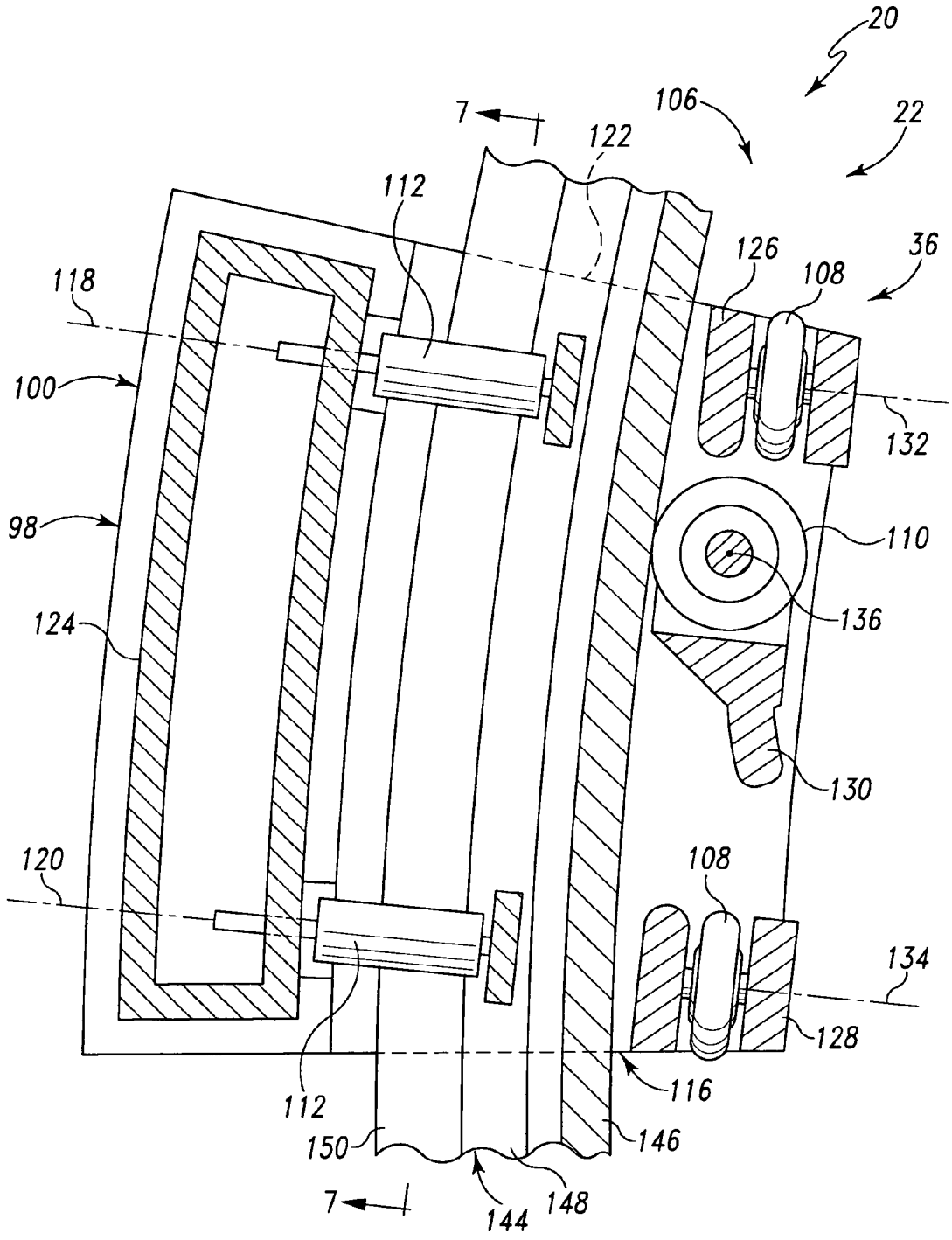
FIG. 6 is a cross-section taken along line 6-6 in FIG. 5.

FIG. 1 depicts a perspective view of the toy vehicle 24, and FIG. 5 depicts a front view of toy vehicle 24. Toy vehicle 24 may include a body 44 supported by a plurality of wheels 46, 47, 48, 49. As used herein, a wheel is considered the rotating structure on which the vehicle is supported, and includes what may be considered to be the tire, if any, as well as the rim on which a tire may be mounted. Each wheel may rotate about an axis of rotation. In this example, wheels 46 and 48 rotate about a common wheel axis 50. Wheels 47 and 49 may also rotate about a similar common wheel axis.

Figure 7:
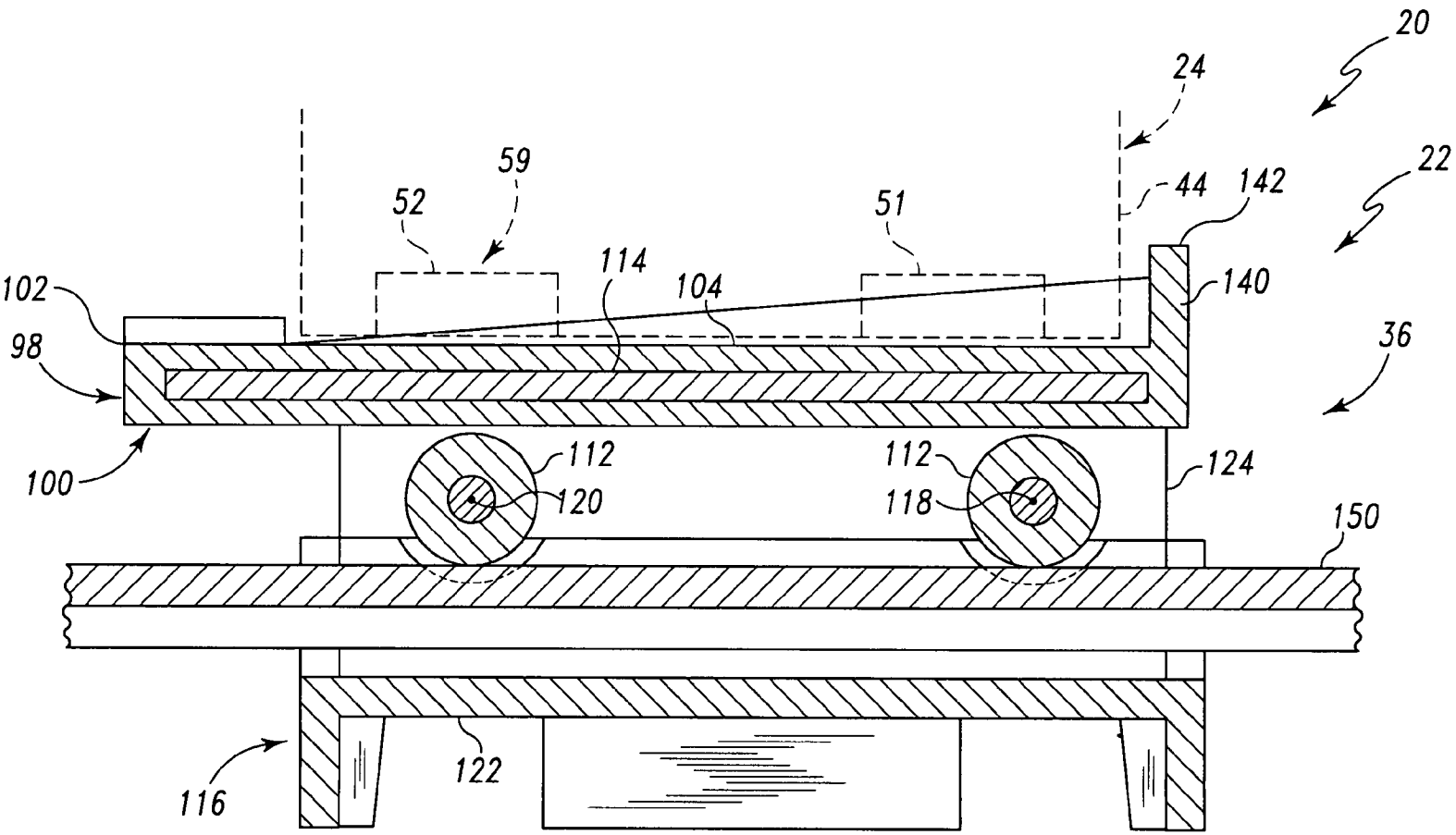
FIG. 7 is a cross-section taken along line 7-7 in FIG. 6.
Figure 9:
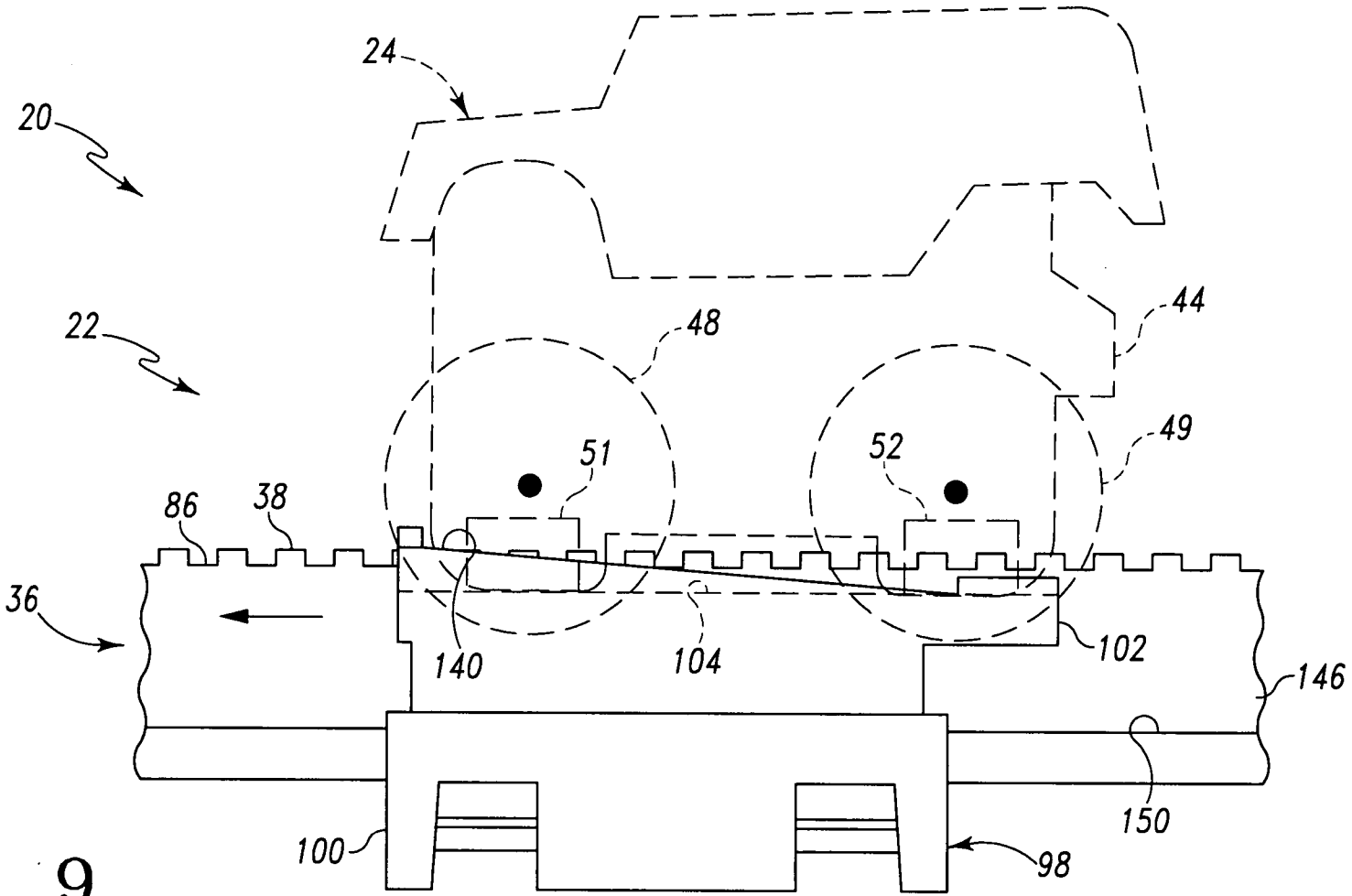
FIG. 9 is a simplified side view of the toy vehicle on the track assembly of FIG. 1.

Furthermore, the toy vehicle 24 may include one or more magnets in or on the underside of body 44. The illustrated toy vehicle has two permanent magnets 51, 52, as shown in FIGS. 5, 7 and 9. The magnet or magnets may each or in combination be any source of a magnetic field. Thus, other forms of magnets may also be used, such as electromagnets. Magnet 51 may be aligned between wheels 46 and 47, while magnet 52 may be aligned between wheels 48 and 49. The magnets 51, 52 may be positioned on the vehicle so that when the vehicle is on a track, the magnets are elevated a sufficient distance above the track to avoid making direct contact with the track. As will be described, the magnets 51, 52 may be positioned sufficiently low to provide a strong magnetic force of attraction with a moveable or stationary track element having a magnetic or ferromagnetic material.

As indicated generally in FIG. 5, toy vehicle 24 may also include an appropriate drive mechanism 53 to facilitate imparting rotational power to one or more of the toy vehicle wheels 46, 47, 48, 49 to drive it along the track in a way described below. Toy vehicle drive mechanisms are well known. Wheels 46 and 47 are on the right side of the vehicle and opposite respective wheels 48 and 49 on the left side of the vehicle. The toy vehicle 24 may be an inertial-motor-powered toy vehicle, such as a toy vehicle sold by Mattel, Inc. under the trademark "Rev Ups.™" Other toy vehicles with or without drive systems may also be used, such as ones with drive systems that are wind-up, battery powered, electric powered or powered by any other drive mechanism.

Figure 3:
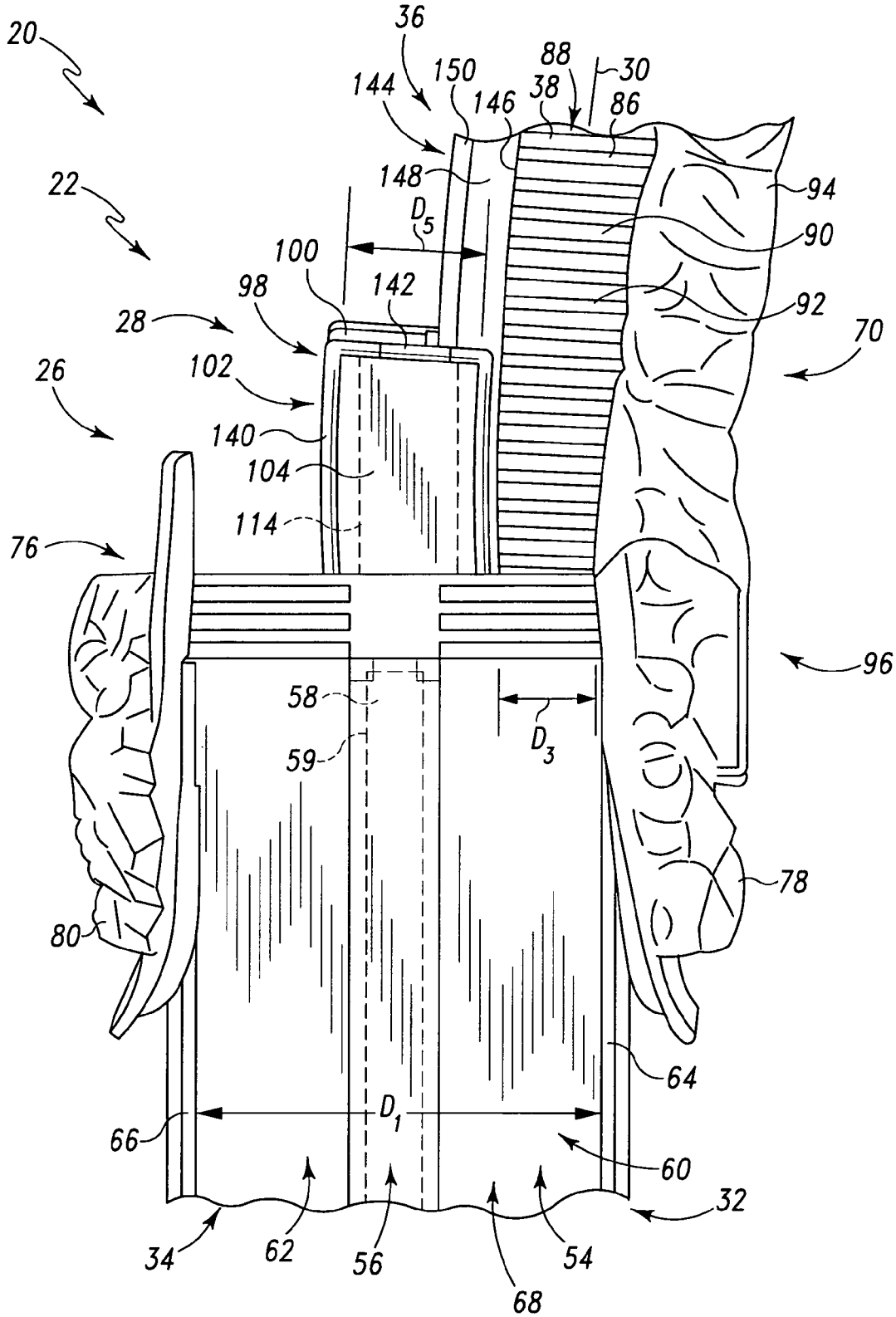
FIG. 3 is a top view of a track transition at the lower end of the track assembly of FIG. 1.

FIG. 2 depicts track set 22 including track assemblies 32, 36 and 40. As also shown in FIG. 3, track assembly 32 may include track 34 having a generally flat vehicle-support surface 54 with a center strip 56 having a ferromagnetic metal strip 58 extending along the length of the track. This strip 58 may be continuous or discontinuous, and may be enclosed within a channel extending through the track 34, or it may be exposed. The complementary magnetic attraction between strip 58 and vehicle magnets 51, 52 contribute to maintaining the vehicle on the track during travel. Optionally, strip 58 may be formed of magnetic material having a polarity opposite to that of magnets 51, 52, and magnets 51, 52 may be replaced with ferromagnetic material. Accordingly, the magnets and the ferromagnetic strip may be referred to generally as magnetic attraction elements 59. Wheel lanes 60 and 62 are disposed on opposite sides of the center strip and are sized to align with respective sets of vehicle wheels 46, 47 and 48, 49 on opposite sides of the toy vehicle.

The track assembly 32 may include raised edges 64, 66 on both sides of track 19, which may function as barriers to keep the toy vehicle 24 from falling off of the track. These track edges may guide the toy vehicle wheels 46-49 along vehicle-support surface 54. Track 34 may be inclined, as shown, to form a ramp 68. One end 70 of the track may be positioned on or near a play surface, or be connected to or an extension of a previous track assembly. The other track end 72 may be supported in an elevated position by a support structure 74.

Figure 4:
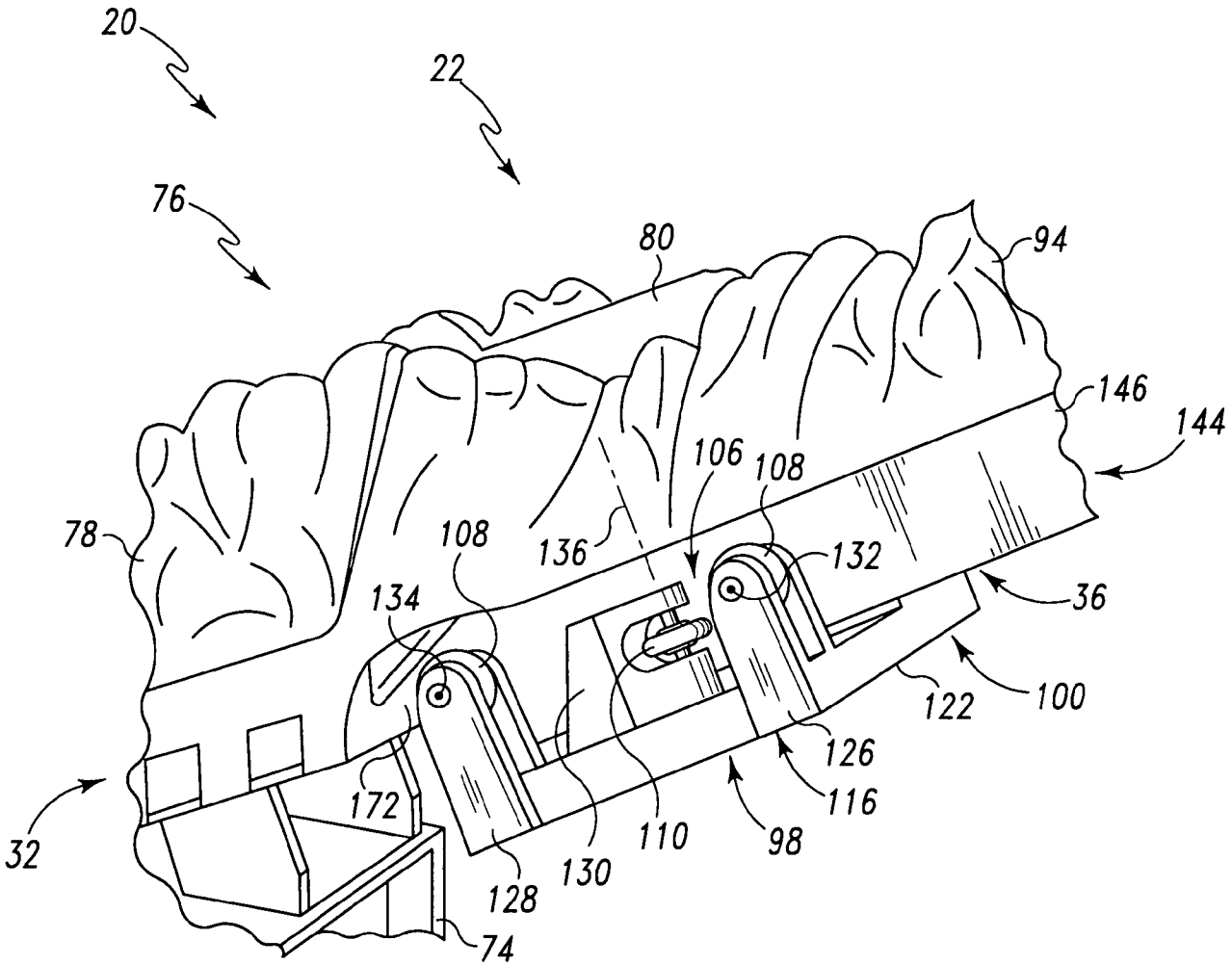
FIG. 4 is a side perspective view of the transition shown in FIG. 2.

In a track-transition region 76, travel path 30 transitions from track 34 to track 38, as particularly shown in FIGS. 2-4. In this transition region, opposing guardrails 78, 80, provide moderate narrowing of track 34, generally consistent with track edges 64, 66 to align a toy vehicle 24 with track 38 of track assembly 36. A distance D1 between guardrails 78, 80 may be slightly more than a distance D2 corresponding to a width of toy vehicle 24, as shown in FIG. 5.

FIGS. 3-7 depict the track assembly 36, referred to as the cliffhanger section 36. The cliff hanger section 36 may include an inclined track 38 that extends between the track assembly 32 on a lower end 70, and track assembly 40 on another, higher end 72. Tracks 34, 38 and 40 may be connected in varying ways, and may utilize any sort of snap fit structure, registration pins, retaining clips, flanges, or any other suitable structure adapted to attach two or more sections of the track to each other. In the illustrated track assembly, these and other connections are made by a snap-fit tab structure.

The track 38 may be sufficiently narrow to support only the wheels on one side of the toy vehicle 24. In the illustrated track assembly, only the right side wheels 46, 47 of the toy vehicle 24 may be in contact with and supported on track 38 when the toy vehicle is traveling along the travel path 30. Track 38 thus may include a vehicle-support surface 86 that forms a single wheel lane 88. At track lower end 70, wheel lane 88 is aligned with wheel lane 60 of track 34. Vehicle-support surface 88 may have a width D3, shown in FIG. 5, that is wider than a width D4 of a vehicle wheel. Optionally, support surface 86 may have a width that is wider or narrower than the width D2 of a vehicle. Since, in this example, only wheels on one side of the toy vehicle contact support surface 86, the width of this support surface may be less than the width D2 of a toy vehicle, and may even be less than the width D4 of a vehicle wheel.

The track 38 may further include a vehicle-support surface 86 that includes a surface structure 90, which may provide increased traction between the track surface 86 and the wheels 46, 47 of the toy vehicle 24 as the toy vehicle progresses along the track. In the illustrated embodiment, surface structure 90 may be in the form of laterally extending ridges 92. Other suitable surface textures, materials or structures may also be used.

The cliffhanger section 36 may also include a wall, barrier or guardrail 94, similar in this example to guardrail 78. The guardrail 94 may be placed along the far right side of the track (along the inside of the curve of the track, as shown) and may resemble a rock wall or other man-made or natural structure. Further, guardrail 94 may be aligned with guardrail 78 and appear as a continuous guardrail 96 formed by individual guardrails 78 and 94.

The cliffhanger section 36 may also include a slide member or carriage 98, as depicted in each of the figures. The cliffhanger section may be configured to support the carriage for movement along travel path 30, such as along the track 38. The carriage 98 may be supported on a side of track 38, such as on the left side as viewed in FIG. 2.

As shown, the carriage 98 may include a carriage frame or body 100 having a platform 102 with a vehicle-support surface 104, contact bearing wheels 106, including in this example, vertical-support bearing wheels 108, lateral-support bearing wheel 110, primary weight bearing wheels shown as rollers 112, and a carriage magnet or ferromagnetic strip 114.

Carriage 98 may be adapted to support all or part of a toy vehicle 24. In the example shown, vehicle-supporting surface 104 has a size appropriate to support a portion of the toy-vehicle body 44 between wheels 46, 47, 48, 49. In particular, surface 104 has a length corresponding to the length of the vehicle body, and a width D5 that is about the same, or slightly less than a distance D6 between opposing pairs of wheels 46, 48 and/or wheels 47, 49.

Two rollers 112 spaced apart longitudinally along path 30 are supported on the underside of platform 102. Rollers 112 have laterally extending axes of rotation 118, 120. Carriage body 100 further includes a base portion 122 spaced below platform 102 by a connecting neck 124 extending down from the side of platform 102 distal of track 38, referred to as the distal side. Base portion 122 extends beyond the proximal edge of the platform (the edge adjacent to track 38) and under track 38. Three bracing arms 126, 128, 130 extend upwardly from the base portion toward the under side of track 38. End arms 126 and 128 terminate with vertical bearing wheels 108. These vertical bearing wheels rotate about horizontal, laterally extending axes 132, 134, respectively, which axes are parallel to axes 118, 120 of rollers 112. Intermediate bracing arm 130 terminates with lateral-support bearing wheel 110, which wheel rotates about a vertical axis 136. The space between wheels 108, 110, platform 102 and base portion 122 forms a generally L-shaped channel 138 when viewed from an end of the carriage, as shown in FIG. 5.

Platform 102 further includes an upwardly extending rim 140 extending above support surface 104. Rim 140 may extend above all or a portion of the support surface. In this example, rim 140 extends along the forward edge of the support surface, as well as along a portion of the sides of the support surface. The height of the rim may be uniform or it may vary. For example, the rim may have an elevated portion 142 along the forward edge, as shown in FIG. 5. Further, it may decrease in height with increasing distance along the sides of the support surface from the forward edge, as shown particularly in FIG. 7.

Also, as shown in FIG. 7, ferromagnetic strip 114 may be embedded in platform 102 just below support surface 104, and extend along the length of the support surface. Strip 114 may be a magnetic attraction element 59 made of a magnetic or ferromagnetic material that provides a magnetically complementary attraction to the magnetic attraction element (s) on the toy vehicle.

Track 38 may be formed in, on or adjacent to a support assembly 116. In this example, track 38 is formed as a part of support assembly 116. Support assembly 116 includes guardrail 94 extending from the edge of the track opposite from carriage 98. The support assembly also includes a carriage-supporting outrigger or frame 144 that may function generally as a guide 145 for guiding the carriage 98 along travel path 30 and track 38. Frame 144 has an L-shape, when viewed from a lateral cross section of the support assembly, as shown in FIG. 5. The L-shape of frame 144 is complementary to channel 138 in the carriage, with the two being sized to allow carriage 98 to move freely along frame 144. Frame 144 includes a generally vertical wall 146 supporting a generally horizontal ledge 148 that terminates in a curved lip, ridge or rail 150 on which carriage rollers 112 rest. Rail 150 may extend along the length of track 38 and may be uniformly spaced from the track in alignment with the carriage rollers. Rail 150, then, may function as a carriage support element 151, and frame 144 may generally function as a guide.

It is seen that, when the carriage is in position with rollers 112 on rail 150, vertical wheels 108 contact the underside of track 78, and lateral wheel 110 contacts the backside of wall 146 of the carriage-supporting frame. The axes of rotation for the rollers 112 and the vertical wheels 108 may also be parallel with the plane of the top surface 104 of the platform 102. In use, platform surface 104 may be generally parallel to and/or aligned with the adjacent surface 86 of track 38. The combination of contact bearing wheels 106, that is wheels 108, 110, and rollers 112, hold the carriage 98 in place relative to track 78. Furthermore, the top surface of the rail 150 may also provide a bearing surface on which the top bearing rollers 112 may roll. With this configuration, the only contacts between the carriage 98 and the support assembly 116 are by wheels 106, which wheels facilitate movement of carriage 98 along support assembly 116. Optionally, wheels 106 may be on support assembly 116, on both of support assembly 116 and carriage 98, or on neither. More or fewer wheels may be used, or other or no friction-reducing devices or mechanisms may be used.

Figure 10:
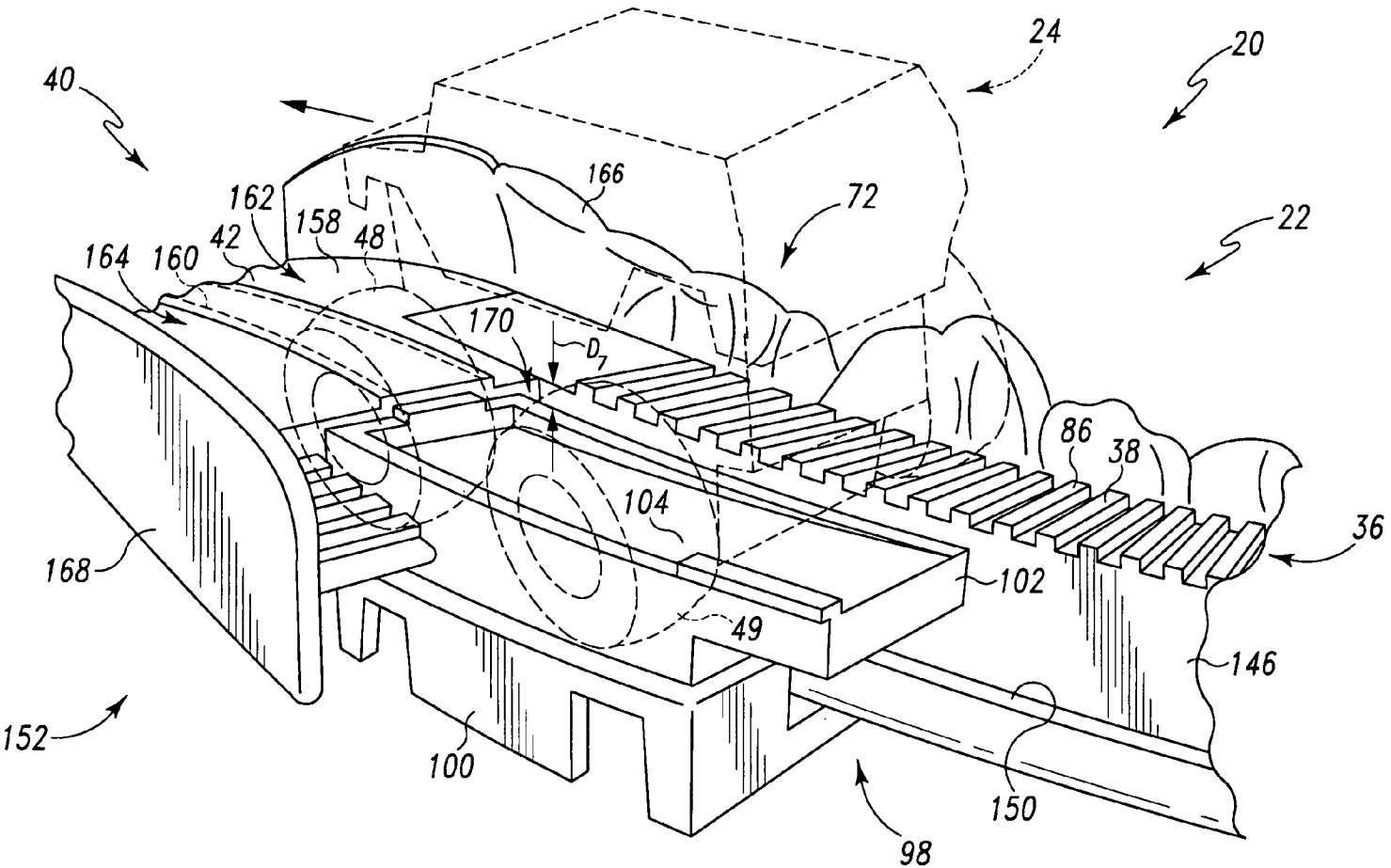
FIG. 10 is a simplified side view of the toy vehicle on a track transition at the top of the track set of FIG. 2.

As shown generally in FIG. 2 and in further detail in FIG. 10, upper end 72 of track 38 may be connected to track 42 of track assembly 40 in a track-transition region 152. The tracks 38 and 42 may be supported in an elevated position, as shown, or in other positions, by suitable support structures, such as support structures 154 and 156. Similar to track 34, track 42 may include a generally flat vehicle-support surface 158 with a center ferromagnetic metal strip 160 extending along the length of the track to facilitate maintaining the vehicle on the track during travel. Wheel lanes 162 and 164 are disposed on opposite sides of the center strip and are sized to align with respective sets of vehicle wheels 46, 47 and 48, 49 on opposite sides of the toy vehicle.

In track-transition region 152, travel path 30 transitions from track 38 to track 42, as particularly shown in FIG. 10. In this transition region, opposing guardrails 166, 168 ensure that a vehicle traveling along track 38 will be aligned with track 42. Track assembly 36 is structured to cause support surface 104 of carriage 98 to drop slightly below the level of surface 86 of track 38 as the carriage 98 reaches upper track end 72. Distance D7 shown in FIG. 10 represents this drop in relative position of surface 104. Lane 162 of track 42 forms a continuation of lane 88 of track 38. However, there is no corresponding lane on track 38 for left wheels 49, 50 of the toy vehicle. There is a recess 170 in track 42 between the ends of lanes 162 and 164 and sized to accommodate platform 102 of the carriage. Thus, when the carriage is disposed in recess 170, as shown in FIG. 10, there is a portion of lane 164 along at least a portion of the left side of the platform, in addition to the continuous lane along the right side of the platform.

Figure 8:
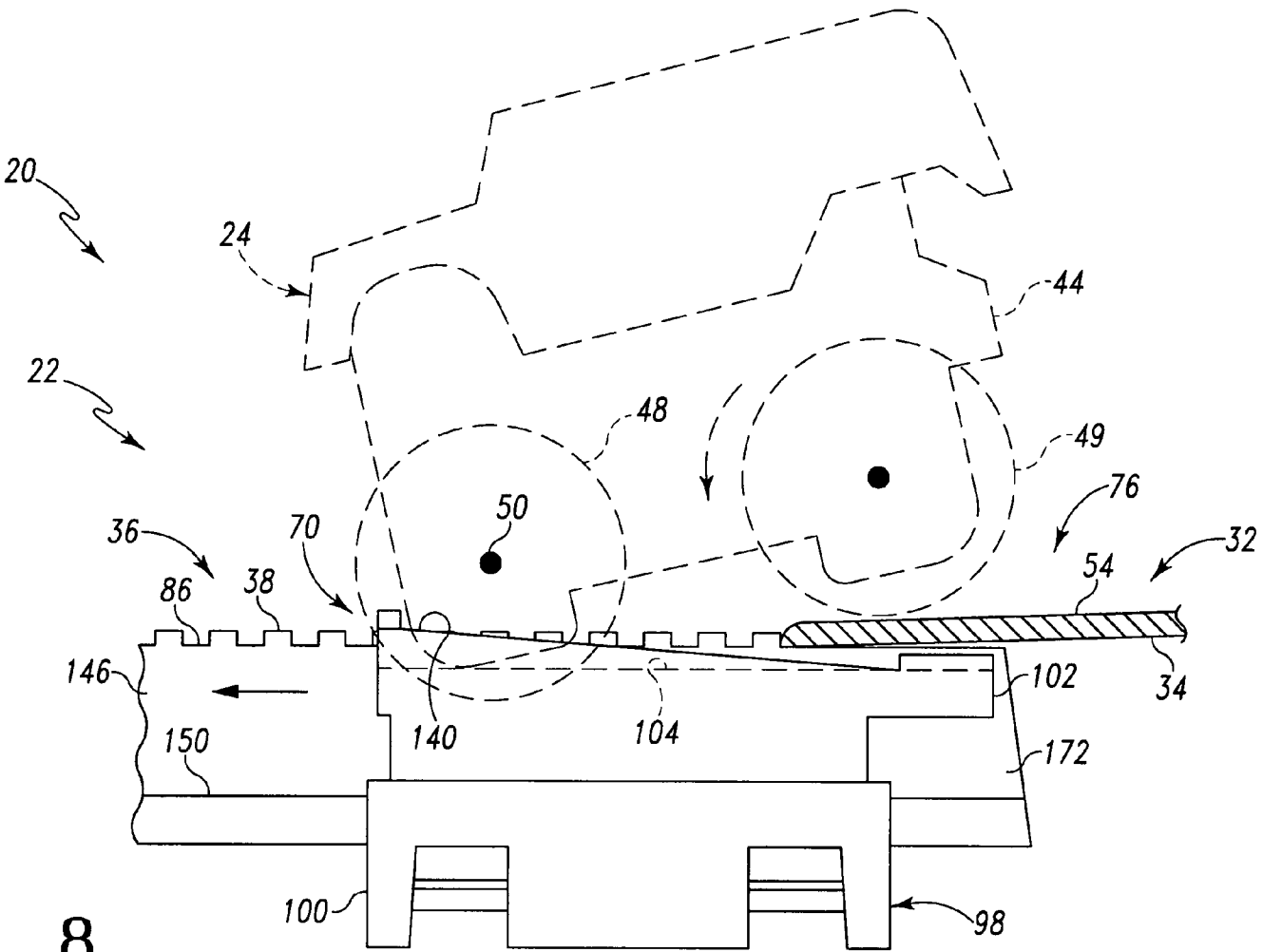
FIG. 8 is simplified side view of a toy vehicle in the track transition of FIG. 3.

FIGS. 8, 9 and 10 collectively illustrate an exemplary use and operation of play set 20. When toy vehicle 24 travels up track 34 along travel path 30, the vehicle reaches lower track transition 76. Because track 38 is inclined upwardly, after the toy vehicle has driven off of the carriage 98, the carriage slides down to the lowest position at the lower end 70 of the track, against a stop element 172 formed in the lower end of track assembly 36, as shown in FIGS. 2-4 and 8. As shown in FIG. 8, vehicle 24 travels off of the end of track 34 and onto track 38. Right wheels 46, 47 continue along on lane 88. However, without a corresponding lane on the right side of the vehicle, the vehicle drops down on the left side until vehicle body 44 contacts platform surface 104. Platform rim 140 may prevent the vehicle from traveling beyond the front edge of the platform. The vehicle body comes to rest on the platform, with the left wheels hanging freely to the side of the platform, and the right wheels in contact with track surface 86. In this position, magnets 51, 52 on the vehicle are magnetically attracted to or drawn toward metal strip 58 in carriage 98, attracting and attaching the carriage to the vehicle.

With the toy vehicle 24 attached to and supported by the carriage 98, wheels 46, 47 are in driving contact with track surface 86, and wheels 48, 49 are not in contact with any surface. The drive mechanism of the toy vehicle may propel both the toy vehicle and the carriage along the cliffhanger section (track assembly) 36, as shown in FIG. 9. Again, the bearing rollers 112 and bearing wheels 108, 110 of the carriage and the traction provided by the ridges 92 of the track facilitate this travel.

The transition of toy vehicle 24 from track assembly 36 to track assembly 40 is illustrated in FIG. 10. As the vehicle and carriage approach transition region 152, the front of the carriage platform 102 enters recess 170, while also lowering in relative position to track surface 86, as is indicated by distance D7. When front left wheel 49 of the toy vehicle comes in contact with left wheel lane 164 of track surface 158, the wheel raises up, lifting the left side of the toy vehicle. With the combination of the lowering of the platform and associated vehicle support surface 104 along and the raising of the left side of the vehicle, the vehicle body 44 lifts away from platform 102, reducing the magnetic attraction between the vehicle magnets and metal strip 114 in the platform, thereby allowing the vehicle to travel off of track 38 and onto track 42.

Because in this example, track assembly 36 is inclined upwardly, after the vehicle leaves carriage 98, the carriage slides back down along carriage-support frame 144 to track assembly 32. The carriage thus returns to the lower, initial position shown in FIGS. 2-4, where the carriage is ready to receive another toy vehicle traveling up ramp 68.

It is thus seen that, in some examples, a toy vehicle play set may include a toy vehicle including a body having first and second opposite sides and a bottom, a plurality of wheels at least partially supporting the body including a first wheel on the first side of the body and a second wheel spaced from the first wheel, a drive mechanism configured to drive at least a first wheel, and at least a first magnetic-attraction element disposed in the bottom of the vehicle body; a track defining a travel path; a carriage adapted to support at least a portion of the toy vehicle and having at least a second magnetic-attraction element complementary with the at least first magnetic-attraction element to provide magnetic attraction between the first and second magnetic-attraction elements, and thereby physical attraction between the carriage and the toy vehicle; and a guide extending along at least a portion of the track and adapted to support the carriage for movement of the carriage along the path; the toy vehicle being adapted to be positioned on the carriage with the first wheel in contact with the track, with the drive mechanism moving the toy vehicle and carriage along the path when the toy vehicle is at least partially supported on the carriage with the first wheel in driving contact with the track and the first and second magnetic-attraction elements in magnetic attraction.

Several aspects of this exemplary method of game play may be modified from that disclosed above. Play may thus be configured to provide a game with a desired degree of complexity or difficulty, for example to adapt the game to players of a predetermined age range.

It is believed that the disclosure set forth above encompasses multiple distinct inventions with independent utility. While an example of each of these inventions has been disclosed in a preferred form, the specific examples thereof as disclosed and illustrated herein are not to be considered in a limiting sense as numerous variations are possible. The subject matter of the disclosures includes all novel and non-obvious combinations and subcombinations of the various elements, features, functions and/or properties disclosed herein. Similarly, where "a" or "a first" element or the equivalent thereof is recited, such usage should be understood to include incorporation of one or more such elements, neither requiring nor excluding two or more such elements.

Inventions embodied in various combinations and subcombinations of features, functions, elements, and/or properties may be claimed through presentation of claims in a related application. Such claims, whether they are directed to different inventions or directed to the same invention, whether different, broader, narrower or equal in scope to the other claims, are also regarded as included within the subject matter of the present disclosure.

What is claimed is:

1. A toy vehicle play set comprising:

an elongate track having a first vehicle-support surface defining a travel path; and a carriage mounted for travel along the travel path and having a second vehicle-support surface, the first vehicle-support surface being disposed during travel of the carriage on only one side of the second vehicle-support surface, there being no vehicle-support surface along the other side of the carriage, the first and second vehicle-support surfaces being configured to support, directly and concurrently a toy vehicle with the first vehicle-support surface in contact with a first part of the toy vehicle and the second vehicle-support surface in contact with a second part of the toy vehicle.

2. The play set of claim 1, further comprising a toy vehicle having a body and at least first and second laterally spaced wheels at least partially supporting the toy vehicle body, the first and second vehicle-support surfaces being generally planar and facing a common direction, and having a combined width that is less than a width of the toy vehicle including the first and second wheels.

3. The play set of claim 2, in which the first wheel has a wheel width, the combined width of the first and second vehicle-support surfaces are at least the wheel width less than the width of the toy vehicle.

4. The play set of claim 2, in which the combined width of the first and second vehicle-support surfaces are sufficiently less than the width of the toy vehicle that, when the vehicle is supported on the first and second vehicle-support surfaces, at least one of the first and second wheels Is not supported on either of the first and second vehicle-support surfaces.

5. The play set claim 4, in which the other of the first and second wheels is supported on the first vehicle-support surface.

6. The play set of claim 5, in which at least the other wheel is powered to rotate about a wheel axis, and the toy vehicle travels along the track with the one wheel unsupported.

7. The play set of claim 2, in which the toy vehicle further includes at least a first magnetic-attraction element and the carriage includes at least a second magnetic attraction element complementary with the at least first magnetic attraction element to provide magnetic attraction between the first and second magnetic-attraction elements, and thereby physical attraction between the carriage and the toy vehicle.

8. The play set of claim 1, further comprising a carriage-support element extending along at least a portion of the first vehicle-support surface, the carriage being supported on the carriage-support element.

9. The play set of claim 8, in which one or both of the carriage and the carriage-support element includes wheels that contact the other of the carriage and the carriage-support element.

10. The play set of claim 9, further comprising a frame extending along the track, and in which the carriage includes an arm extending against a contact surface of the frame spaced from the carriage-support element, the arm including at least one wheel contacting the contact surface, the arm and contact surface being configured to maintain the orientation of the carriage on the carriage-support element.

11. The play set of claim 1, in which the carriage includes a rim extending above and disposed along at least a portion of the second vehicle-support surface.

12. A toy vehicle play set comprising:

a toy vehicle including a body, a first wheel disposed on a first side of the vehicle body, and a second wheel spaced laterally from the first wheel and disposed on a second side of the vehicle body, the first and second wheel being separated by a first width;

a first track configured of support in direct contact toy vehicle, the first track having an end;

a rail supported relative to and extending from the end the first track; and a carriage mounted for travel along the rail and having a vehicle-support surface with a second width that is less than the first width, the carriage being movable along the rail between a position near the end of the first track and a position spaced from the end of the first track with the body between the first and second wheels of the toy vehicle supported on and in contact with the vehicle-support surface and the first wheel being unsupported.

13. The play set of claim 12, in which the first track has a width corresponding to the width of the vehicle, and the vehicle-support surface is disposed to align with the vehicle body between the first and second wheels when the vehicle is disposed on the end of the track for travel along the track.

14. The play set of claim 13, further comprising a second track extending along the rail and disposed adjacent to the vehicle-support surface, the second track being adapted to support and be in contact with the second wheel when the vehicle body is supported on and in contact with the vehicle-support surface.

15. A toy vehicle play set comprising a toy vehicle including a body having first and second opposite sides, a plurality of wheels at least partially supporting the body including a first wheel on the first side of the body and a second wheel on the second side of the body and spaced from the first wheel, a drive mechanism configured to drive at least the first wheel, and at least a first magnetic-attraction element disposed in the vehicle body;

a track defining a travel path;

a carriage adapted to support and be in contact with at least a portion of the toy vehicle and having at least a second magnetic-attraction element complementary with the at least first magnetic-attraction element to provide magnetic attraction between the first and second magnetic-attraction elements, and thereby physical attraction between the carriage and the toy vehicle; and a guide extending along at least a portion of the track and adapted to support the carriage for movement of the carriage along the path;

the toy vehicle being adapted to be positioned on and in direct contact with the carriage with the first wheel in contact with the track, with the drive mechanism driving the first wheel to move the toy vehicle and carriage along the path when the toy vehicle is at least partially supported on and in contact with the carriage with the first wheel in driving contact with the track and the first and second magnetic-attraction elements in magnetic attraction.

16. A method of propelling a toy vehicle along a track comprising supporting a portion of the toy vehicle on and in contact with a carriage with at least a first driven wheel of the vehicle supported on and in contact with a track separate from the carriage;

driving the driven wheel of the supported toy vehicle while the driven wheel is in contact with the track and the portion of the toy vehicle is supported on and in contact with the carriage; and guiding the carriage supporting the toy vehicle along the track.

17. The method of claim 16, in which supporting the toy vehicle further includes supporting the toy vehicle with a second wheel on a side of the toy vehicle opposite the first wheel, projecting beyond the carriage and free of contact with a track.

18. The method of claim 17, further comprising driving the second wheel along with the first wheel while supporting the toy vehicle on the carriage.

19. The method of claim 16, in which guiding the carriage includes supporting the carriage on a rail extending along the track.

20. The method of claim 19, in which supporting the carriage includes maintaining the orientation and lateral position of the carriage on the rail.

21. The toy vehicle, play set of claim 1, further comprising frame to which the track is attached, the carriage being mounted to and supported entirely by the frame and extending laterally beyond the frames.

* * * * *